US005803843A

United States Patent [19]

Anderson et al.

[11] Patent Number: 5,803,843

[45] Date of Patent: Sep. 8, 1998

[54] LOCKABLE ARROW NOCK

[76] Inventors: Vaughn R. Anderson, 217 N. 260 West, Orem, Utah 84057; Marvin L. Carlston, 430 N. 470 West, Lehi, Utah 84043

[21] Appl. No.: 268,246

[22] Filed: Jun. 29, 1994

[51] Int. Cl.[6] ..... F42B 6/06

[52] U.S. Cl. ..... 473/578; 403/277; 403/290

[58] Field of Search ..... 273/416, 419–422; 403/290, 277, 280; 473/578

[56] References Cited

U.S. PATENT DOCUMENTS

| | | | |
|---|---|---|---|
| 582,948 | 5/1897 | Pinover | 403/277 |
| 774,186 | 11/1904 | Ladd | 403/290 X |
| 815,058 | 3/1906 | Atwell | 403/290 |
| 1,449,725 | 3/1923 | Beckert | 403/290 X |
| 2,608,103 | 8/1952 | Shonnard et al. | 403/290 X |
| 4,050,696 | 9/1977 | Troncoso, Jr. . | |
| 4,141,554 | 2/1979 | Sherwin . | |
| 4,305,588 | 12/1981 | Dodge . | |
| 4,496,135 | 1/1985 | Scobie | 403/277 X |
| 4,533,146 | 8/1985 | Schaar . | |
| 4,544,163 | 10/1985 | Scanlon . | |
| 4,671,517 | 6/1987 | Winters . | |
| 4,706,965 | 11/1987 | Schaar . | |
| 4,874,180 | 10/1989 | Fingerson et al. . | |
| 4,943,067 | 7/1990 | Saunders . | |
| 5,067,731 | 11/1991 | Bickel . | |
| 5,154,432 | 10/1992 | Saunders . | |

FOREIGN PATENT DOCUMENTS

| | | | |
|---|---|---|---|
| 571545 | 1/1958 | Italy | 403/277 |
| 1314692 | 4/1973 | United Kingdom | 403/290 |

*Primary Examiner*—Paul E. Shapiro
*Attorney, Agent, or Firm*—Thorpe, North & Western, L.L.P.

[57] ABSTRACT

A nock that mounts to an arrow shaft. The nock is designed of a light weight plastic material. It incorporates the use of a mechanical locking mechanism to secure it to the end of an arrow shaft. The portion of the nock that is inserted into the arrow shaft, or the insert end of the nock, is expanded by a small set screw located inside a cavity in the insert end of the nock. This expansion of the nock presses against the inside walls of the arrow consequently locking the nock in place. The nock is designed to mount securely to the arrow shaft without the use of adhesives or glue.

11 Claims, 3 Drawing Sheets

LOCKABLE ARROW NOCK

BACKGROUND OF THE INVENTION

1. The Field of the Invention

The present invention relates to nock assemblies for arrows. More particularly, the field of the invention is that of nocks that are mechanically secured to arrow shafts.

2. The Background Art

Presently nocks are mounted to arrow shafts using one of the following techniques. Each of these techniques has a number of inherent problems and disadvantages.

The first technique consists of a gluing the nock directly onto a tapered or swedged arrow. Typically, the shaft of an aluminum arrow is a cylindrical tube with an inner bore and a relatively thin rigid outer wall. On prior art aluminum arrows, a tapered nock mounting surface is produced for supporting a nock attached thereto by adhesive. However, swedging the end of an arrow shaft produces a tapered surface which is often off-center or split and thus causes problems in performance of the arrow such as erratic flight paths. In addition to possible defects in the swedged end, the swedging process is also a relatively expensive process which can create a significant amount of scrap.

Another technique of mounting a nock to an arrow shaft consists of gluing a nock mounting adapter into the arrow shaft. The nock mounting adapter has a tapered end to which the nock is glued. This mounting method eliminates the problems associated with defects caused by the swedging process. The nock adapter is inserted into the end of the arrow to provide a nock mounting surface. Such nock mounting adapters are well suited to have nocks glued to them; however the nock adapter must itself be glued into the shaft. This process is time consuming and difficult to perform in the field. Moreover, it can result in the nock and shaft not being concentric as a consequence of the gluing steps. A variation in nock concentricity can cause erratic flight of the arrow.

The third nock mounting technique consists of gluing a thin-walled nock adapter bushing or ring in the end of the arrow shaft. A nock having a round protrusion on the insert end the same diameter as the hole in the nock adapter bushing is pressed into this nock adapter ring. One such design is described in U.S. Pat. No. 5,067,731 (issued on Nov. 26, 1991 to Bickel). These prior art nock and bushing assemblies work well when the arrow shafts are exactly the right diameter, the bushing outside and inside diameters are machined exactly to the right diameters, and the assembly is used at moderate temperatures. This mounting method relies on the press fit of the nock into the nock adapter bushing to hold it securely to the arrow shaft. However, as temperature conditions vary (due to the varying rates of thermal expansions of the nock, bushing and shaft materials) and as the tolerance dimensions of the bushing, nock, and arrow shaft vary, the nock subsequently becomes either too loose or too tight.

Additional mounting techniques include screwing together modular threaded components, as shown for example in U.S. Pat. No. 4,706,965 (issued on Nov. 17, 1987 to Schaar) and U.S. Pat. No. 4,533,146 (issued on Aug. 6, 1985 to Schaar). However, such techniques, as they might be applied to arrow nocks, introduce the disadvantages of the threaded components inadvertently unscrewing, and the difficulty of aligning the bowstring slot with the fletches.

There is thus a need for a nock which can be easily and quickly installed into an arrow shaft without glue, thereby allowing for in-the-field installation. There is a further need for a nock which can be installed so as to be uniformly concentric with the shaft to provide the most accurate arrow flight. The nock needs to be rotatably adjustable and thereby capable of alignment with the arrow fletches (feathers) and/or the broadhead tip. This alignment feature assures the best possible arrow tuning, and subsequent trajectory.

OBJECTS AND SUMMARY OF THE INVENTION

It is therefore an object of the present invention to provide an arrow nock which is mechanically secured to the arrow shaft.

It is a further object of this invention to provide a nock locking mechanism that eliminates the need to use glue or adhesives to secure the nock to the arrow shaft.

It is a further object of this invention to provide a nock locking mechanism that is self aligning, and as the nock is secured to the arrow shaft it aligns itself so as to be concentric with the arrow shaft.

It is a further object of this invention to provide a nock locking mechanism that can be loosened and adjusted, so as to be indexable with fletches and/or broadhead arrow tips.

It is a specific objective of this invention to provide an arrow nock that can be easily removed and accurately replaced.

Other objects and features of the present invention with respect to the following detailed description, taken in combination with the drawings.

The above objects and others not specifically recited are realized in a specific illustrative embodiment of a nock that mounts to an arrow shaft. The nock is designed of a light weight plastic material. It incorporates the use of a mechanical locking mechanism to secure it to the end of an arrow shaft. The portion of the nock that is inserted into the arrow shaft, or the insert end of the nock, is expanded by a small set screw located inside a cavity in the insert end of the nock. This expansion of the nock presses against the inside walls of the arrow consequently locking the nock in place. The nock is designed to mount securely to the arrow shaft without the use of adhesives or glue.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
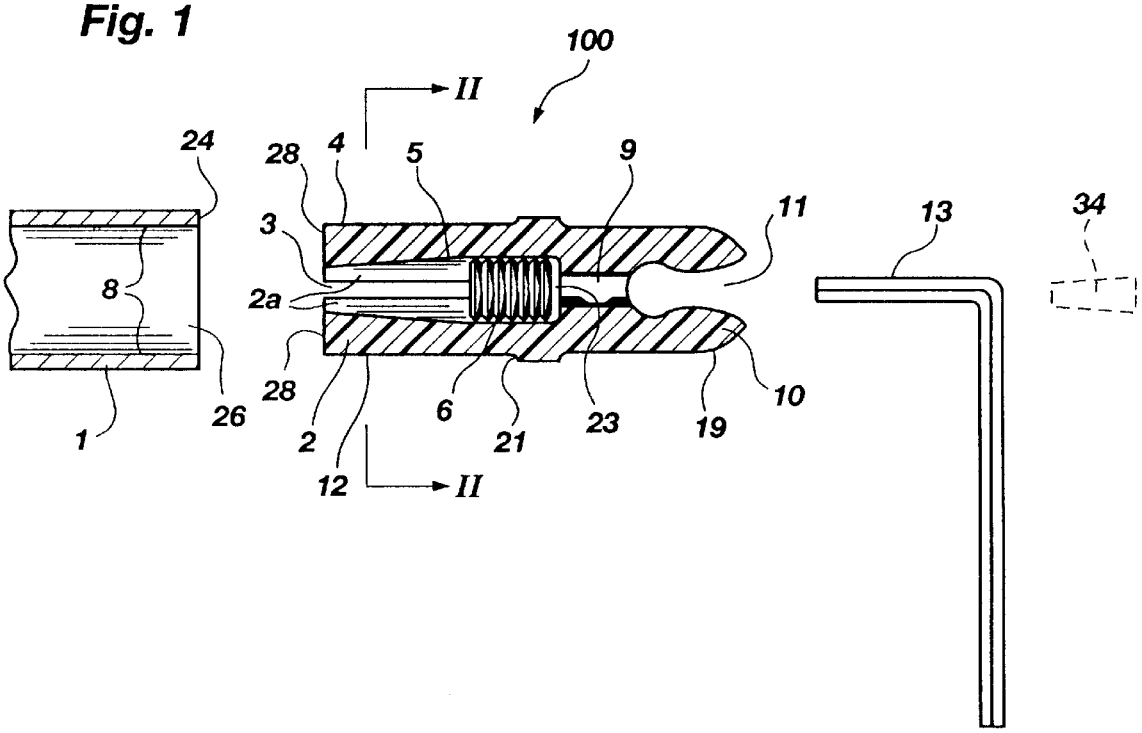
FIG. 1 illustrates a side cross sectional view of an arrow nock made in accordance with the present invention, shown in conjunction with a tubular arrow shaft.

Reference will now be made to the drawings wherein like structures will be provided with like reference numerals.

Referring now to FIG. 1, there is shown an arrow nock, generally designated at 100. The nock 100 includes an insert end 12 integrally connected to a nock end 19, and including an annular shoulder 21 at the junction therebetween. The lockable arrow nock 100 is designed to be inserted directly into a hollow shaft 1 and subsequently locked into place by means of a mechanical locking device 6. The hollow arrow shaft 1 includes a proximal end face 24 and interior side walls 8 defining an open receiving cavity 26. The mechanical locking device 6 frictionally secures the nock 100 to the shaft 1, and thus eliminates the need for gluing. The nock 100 is less sensitive to small variations in the tolerances, and is similarly not sensitive to atmospheric temperature changes.

The nock end 19 includes a notch 11 designed to receive a bow string therein. Bow string receptacles 10 define the notch 11. The insert end 12 includes a plurality of finger-like protrusions 2 configured and dimensioned for telescopic insertion into the receiving cavity 26 of the shaft 1 to frictionally engage with the interior side walls 8. The nock 100 thereby accepts and transfers the launching force of a bow and string to an arrow shaft 1. The protrusions 2 are laterally spaced apart to form small slits 3 that extend typically from the shoulder 21 to distal ends 28 of the protrusions. The purpose of the slits 3 is to provide lateral flexibility to the finger-like protrusions 2. The finger-like protrusions 2 include inner side walls 2*a* which collectively form a receiving compartment 5. The compartment 5 is profiled such that its cross-sectional area adjacent the distal ends 28 is smaller than its cross-sectional area adjacent the shoulder 21.

Within the compartment 5 resides a small set-screw 6. The diameter of the set-screw 6 is approximately the same as or slightly smaller than the diameter of the compartment near the shoulder 21, but is slightly larger than the diameter of the compartment 5 near the distal ends 28. The nock 100 includes an access hole 9 formed between the compartment 5 and the notch 11 to provide access to the set-screw 6. An Allen™ or hex wrench 13 can be used to screw the set-screw 6 into the inner side walls 2*a* to thereby move the protrusions 2 into frictional engagement with the interior side walls 8 of the shaft 1.

Figure 2:
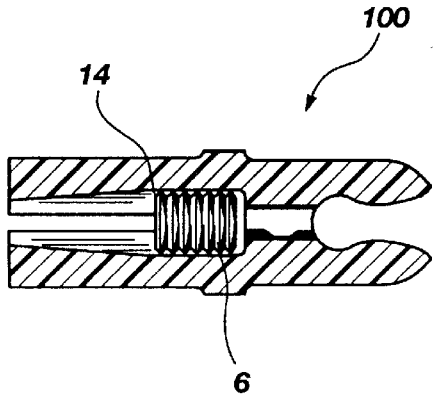
FIG. 2 illustrates a side, cross sectional view of the nock of FIG. 1 in relaxed condition.
Figure 3:
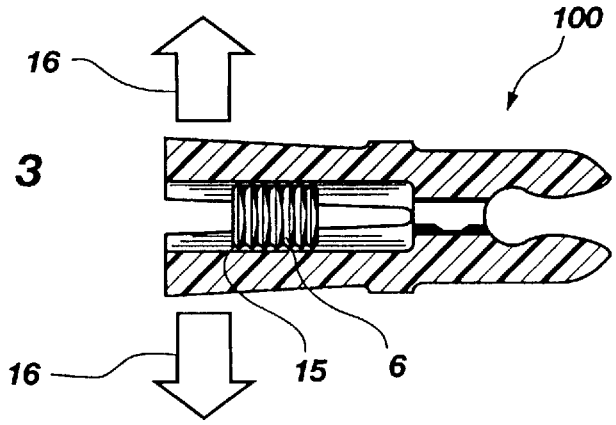
FIG. 3 illustrates a side, cross sectional view of the nock of FIGS. 1–2 in a locked condition.
Figure 6:
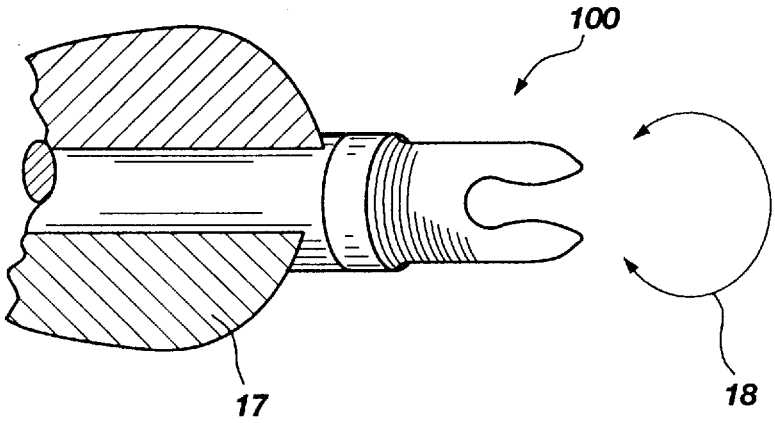
FIG. 6 illustrates a side, perspective of the nock of FIG. 1 installed into a tubular arrow shaft.

To install the nock into an arrow shaft, the insert end 12 of the nock is inserted into the cavity 26 of the arrow shaft 1. The finger-like protrusions 2 slide into said shaft. When the nock is fully inserted into the cavity 26 the proximal end face 24 of the shaft abuts against the should 21 of the nock. The nock can then be rotated in directions 18 shown in FIG. 6 so as to be aligned with arrow fletches 17 as desired. When the nock is properly adjusted, the Allen™ wrench 13 is inserted through the access hole 9 and into a polygonal recess 23 of the set-screw 6. The set-screw 6 is then screwed from its relaxed position 14 shown in FIG. 2, to a locked position 15 as shown in FIG. 3. The set-screw is screwed axially toward the distal ends 28 of the protrusions 2. Since the compartment 5 is smaller at the distal ends 28 than the set-screw 6, the flexible, finger-like protrusions are pressed radially outward and exterior side walls 4 of said protrusions are wedged against the interior side walls 8 of the arrow shaft 1. The outward spreading of the protrusions 2 is depicted by arrows 16 in FIG. 3. This wedging action of the nock 100 locks it securely in the arrow shaft 1 in frictional engagement.

To remove the nock, the Allen™ or hex wrench is again inserted into the access hole 9 and into the recess 23 of the set-screw 6. The set-screw 6 is then screwed axially away from the distal ends 28 of the protrusions 2 and releases the insert end 12 from frictional engagement with the interior side walls 8 of the shaft 1.

Figure 7:
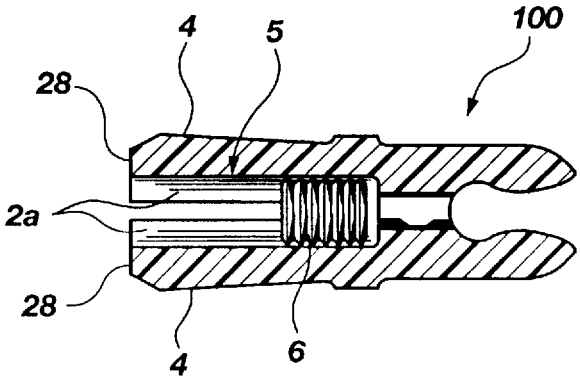
FIG. 7 illustrates an alternative embodiment of the reverse-tapered arrow nock of FIG. 1.
Figure 8:
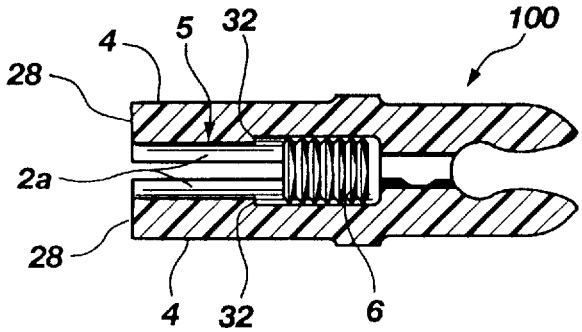
FIG. 8 illustrates an alternative embodiment of the reverse-tapered arrow nock of FIG. 1.
Figure 9:
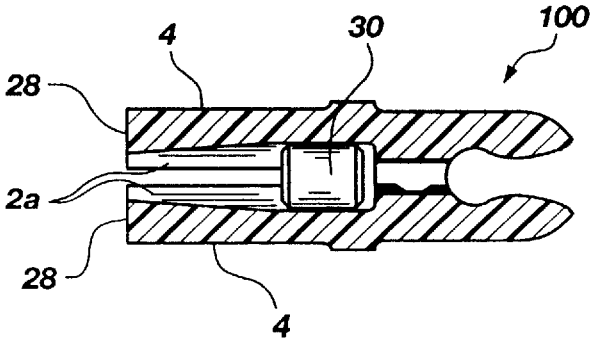
FIG. 9 illustrates an alternative embodiment of the reverse-tapered arrow nock of FIG. 1.

It is to be understood that the structures and features described herein can be embodied in many different forms. The presently preferred embodiment as illustrated in FIGS. 1–3 includes the inner side walls 2*a* in a reverse tapered configuration, i.e. the inner side walls 2*a* taper radially inward toward the distal ends 28 of the protrusions 2. The exterior side walls 4 and preferably straight and cylindrical. It will be appreciated that this combination of features results in the exterior side walls 4 being pushed radially outward when the set screw 6 is advanced toward the distal ends 28. Alternatively and by illustration only, the inner side walls 2*a* can be straight and non-tapered while the exterior side walls 4 are outwardly tapered as in FIG. 7, with the set screw 6 being preferably wider than the compartment 5 formed by the side walls 2*a*. The alternative embodiment of FIG. 8 illustrates stepped interior side walls 2*a,* including stepped structure 32 wherein at least the distal portion of the compartment 5 is narrower than the set screw 6. The embodiment of FIG. 9 depicts the cylindrical exterior side walls 4 and inwardly-tapered interior side walls 2*a* as in FIGS. 1–3, but includes a plug 30, instead of the set screw 6, which is advanceable toward the distal ends 28 in any suitable manner to push the walls 4 radially outward. As a further alternative shown in FIG. 1, a tapered plug 34 could be designed to be inserted through the access hole 9 to matingly engage with the inner side walls 2*a* of the protrusions 2 to force the protrusions laterally outward into frictional contact with the interior side walls 8 of the shaft 1. Removal of the plug 34 releases the protrusions 2 from frictional engagement with the interior side walls 8 of the shaft 1.

It will be appreciated that advancement of the set screw 6 in the embodiments of FIGS. 1–3 and 7–8 operates to press the exterior side walls 4 radially outward, and that advancement of the plug 30 in FIG. 9 also accomplishes the radially outward advancement of the side walls 4. It can thus be seen from the alternatives of FIGS. 1 and 7–9 that any suitable means for moving the exterior side walls 4 of the protrusions 2 radially against the interior side walls 8 of the shaft 1, and/or releasing said exterior side walls 4 from engagement with said interior side walls 8, is within the scope of the present invention.

It is preferable that the insert end 12 be of a circular exterior shape to conform with circular interior side walls 8 of the shaft 12, but the side walls 8 and the insert end 12 may alternatively form any other shape suitable for the purposes of the invention.

Figure 4:
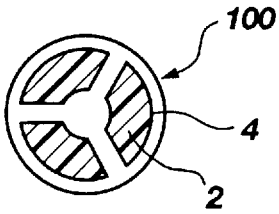
FIG. 4 illustrates a cross sectional view of the nock of FIG. 1, taken along section B—B.
Figure 5:
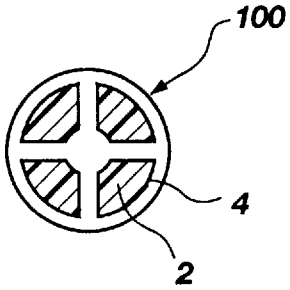
FIG. 5 illustrates an alternative embodiment of the nock of FIG. 4.

There are preferably three protrusions 2 as shown in FIG. 4, although four protrusions 2 as in FIG. 5 or more or less protrusions may be used to design an embodiment of the present invention. Alternatively, the nock 100 may comprise a solid tubular wall without any protrusions wherein the tubular wall is made of resilient expandable material which expands radially outward responsive to advancement of the set screw 6 within the compartment 5. The protrusions 2 are preferably of a common, uniform size and dimension, and are preferably positioned such that the receiving compartment 5 resides in a substantial co-axial orientation relative to the entire nock 100. It will be appreciated that such a configuration provides a self-centering, self-aligning capacity to the nock 100. As the set screw 6 is advanced axially toward the distal ends 28 to press the protrusions 2 laterally against the interior side walls 8, the entire nock 100 is brought into a co-axial alignment with respect to the receiving cavity 26 of the shaft 1.

It will be appreciated that the mechanical locking feature described herein provides the ability to selectively screw/unscrew the set screw 6 in order to lock/unlock the nock 100 to the shaft 1. The recess 23 and the wrench 13 may be of any correspondingly polygonal shapes, or any other suitable noncircular shapes in enable radial engagement therebetween. The nock 100 is preferably made of polycarbonate or plastic, but may be made from any other suitable material including metal. As the set screw 6 is screwed axially toward the distal ends 28 of the protrusions 2 and thus in lateral engagement with the protrusions, threads of the set screw tap their own grooves into the plastic material.

A preferred method for fabricating an arrow nock in accordance with the present invention includes the steps of:

(a) forming a nock body including an insert end portion and an opposing nock end portion, such that said insert end portion includes exterior side walls and is configured and dimensioned for telescopic insertion into the open receiving cavity of the shaft, and such that said nock end portion includes a receiving slot configured for receiving a bowstring therein; and (b) forming locking means engagable with the nock body for selectively moving the exterior side walls of the insert end portion radially outward into contact with the interior side walls of the shaft such that said insert end portion is held in frictional engagement with said interior side walls to thereby lock said insert end portion to the shaft.

The present invention represents a significant advance in the field of arrow nocks. It is noted that many of the advantages of the present invention accrue from the combination of a one-piece nock 100 having a notch 11 in communication with a receiving compartment 5 via an access hole 9. This combination permits utilization of the set screw 6 to selectively lock/unlock the nock 100 onto/from the arrow shaft 1 in a purely mechanical manner. The mechanical nature of the invention negates the need for glue and enables the nock 100 to be loosened and tightened repeatably. The mechanically lockable/releasable aspect of the invention permits rotational adjustment of the nock 100 with respect to the fletches 17 at any time. The disadvantages in the prior art noted above and others not discussed are overcome to a significant degree by the present invention. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. An arrow nock for attachment to a tubular end of an arrow shaft as part of an arrow, said tubular end having interior side walls defining an open receiving cavity of the arrow shaft, said arrow nock comprising:

an arrow nock body including an insert end portion and an opposing nock end portion, said insert end portion including exterior side walls and being configured and dimensioned for telescopic insertion into the open receiving cavity of the arrow shaft in an axial direction with respect to the arrow shaft, said nock end portion including a receiving slot configured for receiving a bowstring therein; and locking means for locking the arrow nock body to the arrow shaft, including means engageable with the nock body for selectively moving the exterior side walls of the insert end portion radially outward into contact with the interior side walls of the arrow shaft such that said insert end portion is held in frictional engagement with said interior side walls to thereby lock said insert end portion to the arrow shaft.

2. An arrow nock as defined in claim 1, wherein the insert end portion further comprises a plurality of laterally spaced-apart protrusions, the locking means comprising means for selectively spreading the protrusions radially apart from each other into contact with the interior side walls of the shaft.

3. An arrow nock as defined in claim 2, wherein the protrusions include inner side walls which collectively form a receiving compartment, the locking means further comprising:

a set screw configured for placement within the receiving compartment so as to reside within a first portion of said receiving compartment, said set screw having a diameter which is larger than a radial dimension of a second portion of the receiving compartment; and means for selectively moving the set screw into engagement with the inner side walls of the protrusions at the second portion of the receiving compartment to cause said set screw to press the protrusions radially outward.

4. An arrow nock as defined in claim 3, wherein the set screw includes an open polygonal recess formed at one end thereof, and wherein the means for advancing the set screw includes a polygonal insert member corresponding in shape to the open polygonal recess and being configured and dimensioned for engagement with defining sides of said recess to enable said insert member to rotatably advance the set screw into engagement with the inner side walls of the protrusions at the second portion of the receiving compartment.

5. An arrow nock as defined in claim 3, wherein the inner side walls of the protrusions which form the second portion of the receiving compartment taper radially inwardly toward distal ends of the protrusions, and wherein the locking means further comprises means for axially advancing the set screw toward the distal ends of the protrusions and thus into engagement with the inner side walls of the protrusions at the second portion of the receiving compartment to enable the set screw to press the protrusions radially outward.

6. An arrow nock as defined in claim 5, wherein the protrusions are of a common, uniform size and dimension and are positioned so as to form the receiving compartment in a substantial co-axial orientation relative to the nock body such that said nock body becomes centered with respect to the open receiving cavity of the shaft responsive to axial advancement of the set screw into contact with the radially tapered protrusions.

7. An arrow nock as defined in claim 5, wherein the nock body includes an access hole formed therein between the receiving compartment of the insert end portion and the receiving slot of the nock end portion to place said receiving slot in communication with said receiving compartment, such that the set screw is accessible from the access hole by a screw-turning device to enable a user (i) to selectively screw the set screw into engagement with the inner side walls of the protrusions to thereby lock the insert end portion in frictional engagement with the shaft, and (ii) to selectively unscrew the set screw to thereby release the insert end portion from frictional engagement with the shaft.

8. An arrow nock as defined in claim 1, wherein the locking means includes means for selectively releasing the insert end portion from frictional engagement with the interior side walls of the shaft to enable rotational adjustment of the nock body.

9. A method for fabricating an arrow nock for attachment to a tubular end of an arrow shaft as part of an arrow, said tubular end having interior side walls defining an open receiving cavity of the arrow shaft, said method comprising the steps of:

(a) forming an arrow nock body including an insert end portion and an opposing nock end portion, such that said insert end portion includes exterior side walls and is configured and dimensioned for telescopic insertion into the open receiving cavity of the arrow shaft, and such that said nock end portion includes a receiving slot configured for receiving a bowstring therein; and (b) forming locking means for locking the arrow nock body to the arrow shaft, including means engagable with the nock body for selectively moving the exterior side walls of the insert end portion radially outward into contact with the interior side walls of the arrow shaft such that said insert end portion is held in frictional engagement with said interior side walls to thereby lock said insert end portion to the arrow shaft.

10. A method as defined in claim 9, wherein step (a) further comprises forming the insert end portion to be hollow so as to include a receiving compartment therein, said method further comprising the step of:

(c) forming an access hole in the nock body between the receiving compartment of the insert end portion and the receiving slot of the nock end portion to place said receiving slot in communication with said receiving compartment;

wherein step (b) further comprises placing manually operable locking means within the receiving compartment such that said locking means is accessible from the access hole for selectively locking the insert end portion to the shaft.

11. An arrow comprising:

an elongate arrow shaft having a hollow tubular end, said tubular end including interior side walls defining an open receiving cavity;

an arrow nock body including an insert end portion and an opposing nock end portion, said insert end portion including exterior side walls and being configured and dimensioned for telescopic insertion into the open receiving cavity of the arrow shaft in an axial direction with respect to the arrow shaft, said nock end portion including a receiving slot configured for receiving a bowstring therein; and locking means for locking the arrow nock body to the arrow shaft, including means engageable with the nock body for selectively moving the exterior side walls of the insert end portion radially outward into contact with the interior side walls of the arrow shaft such that said insert end portion is held in frictional engagement with said interior side walls to thereby lock said insert end portion to the arrow shaft.

* * * * *